US006018891A

United States Patent [19]

Duclos

[11] Patent Number: 6,018,891

[45] Date of Patent: Feb. 1, 2000

[54] SHOE CONSTRUCTION

[75] Inventor: Gary P. Duclos, Newburyport, Mass.

[73] Assignee: The Rockport Company, Inc., Marlboro, Mass.

[21] Appl. No.: 09/162,163

[22] Filed: Sep. 29, 1998

[51] Int. Cl.[7] ..... A43B 13/42; A43B 23/08

[52] U.S. Cl. ..... 36/69; 36/92; 36/102; 36/69

[58] Field of Search ..... 36/92, 102, 68, 36/69

[56] References Cited

U.S. PATENT DOCUMENTS

| | | |
|---|---|---|
| 638,879 | 12/1899 | Packard . |
| 1,602,557 | 10/1926 | Steil . |
| 2,200,665 | 5/1940 | Ruszczyk . |
| 2,211,509 | 8/1940 | Lumbard . |
| 2,232,767 | 2/1941 | Brophy . |
| 2,420,466 | 5/1947 | Cordeau . |
| 2,656,620 | 10/1953 | Taylor . |
| 2,661,549 | 12/1953 | Linder et al. . |
| 2,822,557 | 2/1958 | Stritter . |
| 2,866,211 | 12/1958 | Herlihy . |
| 2,994,136 | 8/1961 | Reinhart et al. . |
| 3,170,253 | 2/1965 | Johnson . |
| 3,785,915 | 1/1974 | Closson, Jr. . |
| 4,224,747 | 9/1980 | Winfield . |
| 4,231,169 | 11/1980 | Toyama et al. . |
| 4,322,895 | 4/1982 | Hockerson . |
| 4,484,397 | 11/1984 | Curley, Jr. . |
| 4,501,076 | 2/1985 | Dodds . |
| 4,551,929 | 11/1985 | Paris . |
| 4,625,435 | 12/1986 | Ueda . |
| 4,689,901 | 9/1987 | Ihlenburg . |
| 4,704,808 | 11/1987 | Bianchini et al. . |
| 4,852,275 | 8/1989 | Bianchini et al. . |
| 4,854,055 | 8/1989 | Sugiyama et al. . |
| 5,408,761 | 4/1995 | Gazzano . |

FOREIGN PATENT DOCUMENTS

| | | |
|---|---|---|
| 0146208 | 6/1985 | European Pat. Off. . |
| 525963 | 9/1921 | France . |
| 446658 | 3/1949 | Italy . |
| 272234 | 5/1951 | Switzerland . |
| 318360 | 9/1929 | United Kingdom . |
| 2114869 | 9/1983 | United Kingdom . |

*Primary Examiner*—Ted Kavanaugh
*Attorney, Agent, or Firm*—Sterne, Kessler, Goldstein & Fox P.L.L.C.

[57] ABSTRACT

A shoe construction is described in which a molded cup is provided with a flange extending outwardly from a top edge of the molded cup. A lasting margin of the upper of the shoe is wrapped around the outwardly extending flange and terminates on an exterior surface of the molded cup. The shoe is constructed such that the wearer's foot rests on an upper surface of a base of the molded cup. The outwardly extending flange is located some vertical distance above the bottom of the wearer's foot. The outwardly extending flange improves lateral stability by resisting the torque created by the horizontal component of the wearer's weight acting against a friction or other force acting at the bottom of the shoe. The variable location of the outwardly extending flange also provides a variety of aesthetic designs for the shoe.

16 Claims, 4 Drawing Sheets

SHOE CONSTRUCTION

FIELD OF THE INVENTION

This invention relates to shoes, more particularly to shoes with a rigid back part for stability and a flexible front part for comfort.

BACKGROUND OF THE INVENTION

Conventionally made lightweight shoes that may be used for walking or other similar activity frequently have relatively flexible soles and are cement lasted. This type of construction is cost efficient. However, the heel counters of such shoes typically have inwardly turned lasting flanges and therefore offer little resistance to heel roll over or pronation when walking.

U.S. Pat. Nos. 4,852,275 (the '275 patent) and 4,704,808 (the '808 patent) disclose a shoe with a heel counter having an outwardly extending flange to increase stability and resistance to roll over. However, the construction disclosed in the '275 and '808 patents requires the rearpart of the upper to be stitched through the outwardly extending flange to a sole component, such as the insole. While this type of construction adds stability to the rear part of the shoe, it also increases the cost to manufacture the shoe. Additionally, the outwardly extending flange needs to be located at the interface between the insole and the outwardly extending flange, thereby limiting the design possibilities for shoes utilizing this construction.

It is therefore an object of this invention to provide a lightweight shoe with improved lateral stability to the foot and resistance to roll over, particularly at the rear part of the shoe.

It is a further object of this invention to provide a lightweight shoe with improved lateral stability that allows for a variety of construction methods to be utilized for manufacture, such as cement lasting the upper to the sole.

It is a further object of this invention to provide a lightweight shoe with improved lateral stability that allows for a variety of design variations by varying the location of the outwardly extending flange and eliminating the requirement that the upper be stitched through the flange to the insole.

SUMMARY OF THE INVENTION

The present invention provides improved lateral stability by providing a molded cup, wherein the wearer's foot rests, with a flange extending outwardly from a top edge of the molded cup. This outwardly extending flange increases the stability of a shoe because it is located a vertical distance above the bottom of the wearer's foot. Additionally, a lasting margin of the upper of the shoe is wrapped around the outwardly extending flange of the molded cup. This provides additional stability by unifying the pliable material of the upper with the stiffer material of the molded cup.

By varying the mold of the molded cup, the location of the outwardly extending flange in relation to the shoe can be varied. For example, the mold can be made deeper such that the outwardly extending flange is located higher in the shoe. This variability allows for different aesthetic designs for different shoe models.

BRIEF DESCRIPTION OF THE FIGURES

The accompanying drawings, which are incorporated in and form part of the specification, illustrate embodiments of the present invention and, together with the description, serve to explain the principles of the invention. In the drawings.

DETAILED DESCRIPTION OF THE PREFERRED EMBODIMENTS

Reference will be made in detail below to the preferred embodiments of present invention illustrated in the accompanying drawings. It should be noted that similar or identical structure is identified using identical reference numbers.

Figure 1:
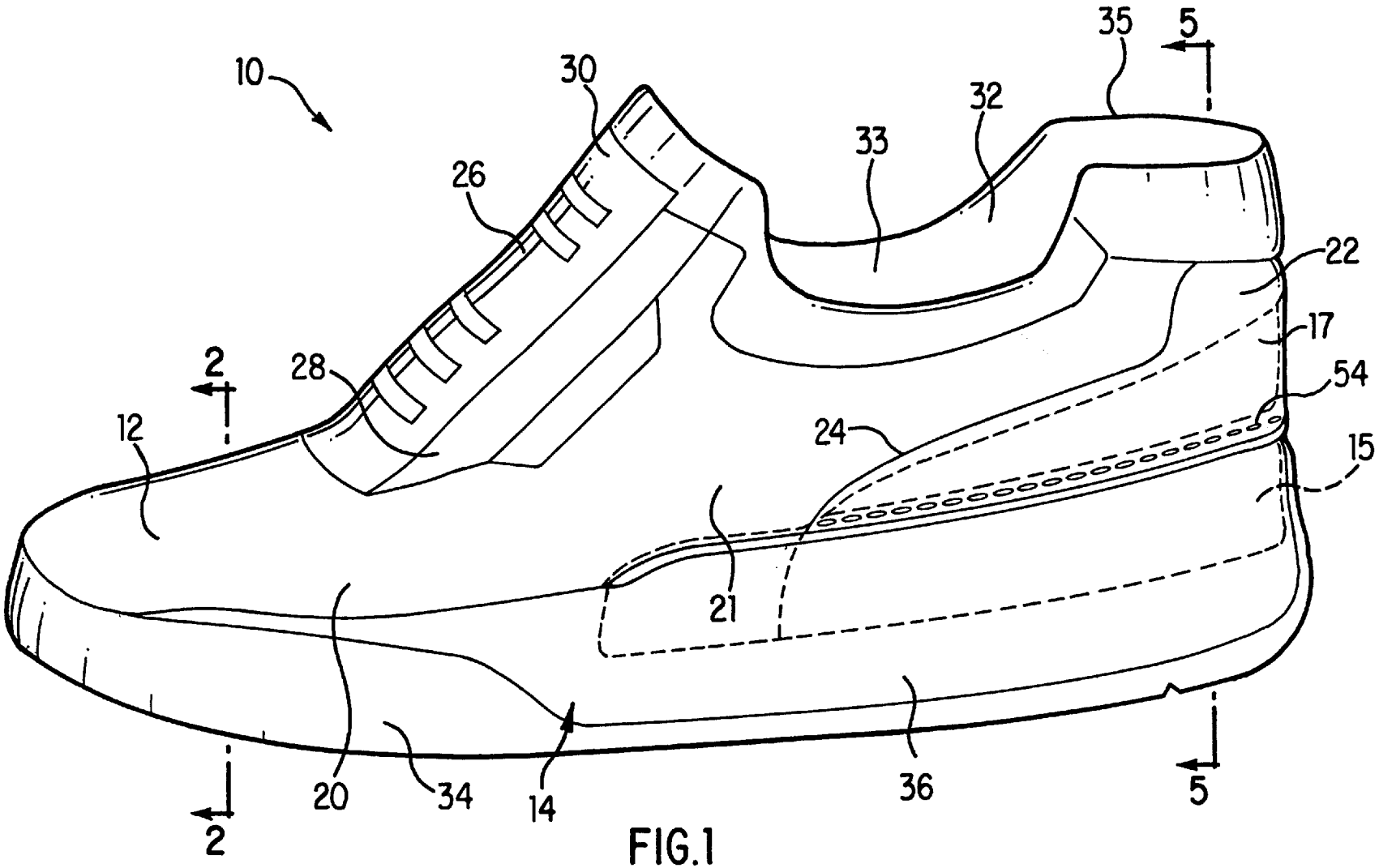
FIG. 1 is a perspective view of a walking shoe constructed in accordance with the invention presently disclosed.

Referring now to a preferred embodiment, a walking shoe is shown generally at 10 in FIG. 1. Shoe 10 includes an upper 12, a sole 14, a molded cup 15 (shown in phantom in FIG. 1), and a heel counter 17 (shown in phantom in FIG. 1). Upper 12 has a vamp 20, medial and lateral quarter panels 21, and foxing 22. Foxing 22 is connected to quarter panels 21 along pattern line 24. Vamp 20 is provided with a lace opening 26, finished by an eyestay 28 and a tongue 30. A lining 32 is stitched to upper 12 and extends about an inner surface of vamp 20 and quarter panels 21. Lining 32 may be made of pig skin, fabric or other similar material, or combinations thereof. A heel collar 33 is provided around an ankle opening 35 for increased comfort of the wearer. Heel counter 17 is disposed in the heel area of upper 12 and between upper 12 and lining 32. Molded heel cup 15 is disposed in the heel area of shoe and will be described in greater detail below.

Figure 2:
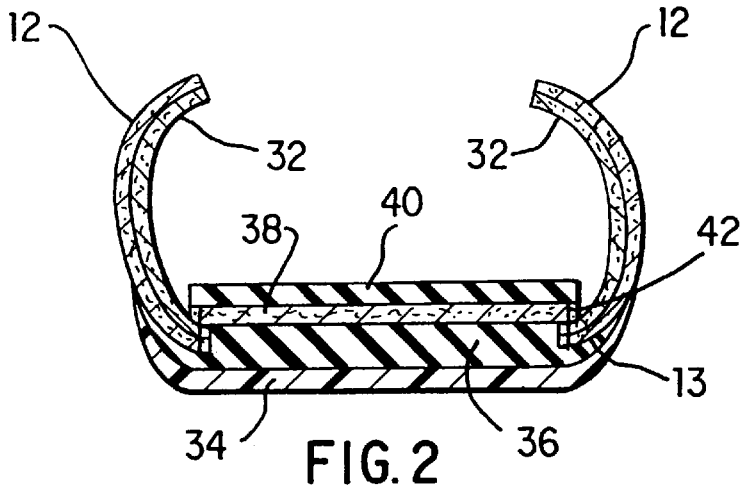
FIG. 2 is a fragmentary cross-sectional view of the front portion of the shoe taken along section line 2—2 of FIG. 1.

Sole 14 is comprised of an outsole 34, a midsole 36, and an insole 38, as best seen in FIG. 2. FIG. 2 depicts a section through the front portion of shoe 10, showing a conventional strobel construction in which lining 32 and a lasting margin 13 of upper 12 are joined to insole 38 by stitching 42. Alternatively, lasting margin 13 of upper 12 may be cemented to insole 38. In a preferred embodiment, insole 38 may be constructed of leather or fabric, but also may be made of other materials generally known in the industry. A conventional footbed 40 may be placed inside the shoe above insole 38.

Figure 3:
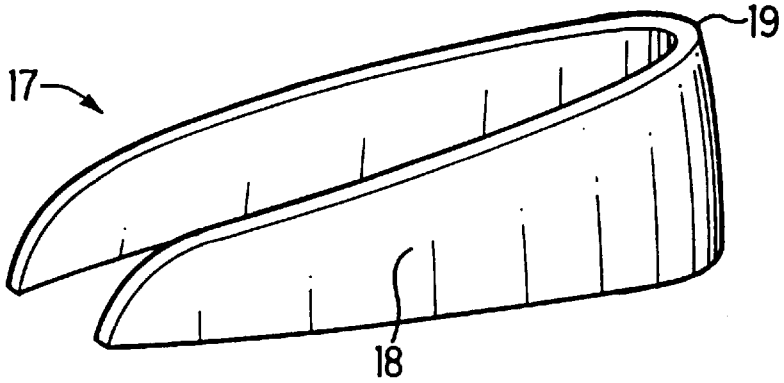
FIG. 3 is a perspective view of a heel counter.

Heel counter 17 is generally U-shaped when viewed from above, as best seen in FIG. 3. In a preferred embodiment, heel counter 17 has a relatively stiff side wall 18 which extends about the heel portion of upper 12 and increases in height towards its center 19. Heel counter 17 may be made of fiberboard or other generally known materials.

Figure 4:
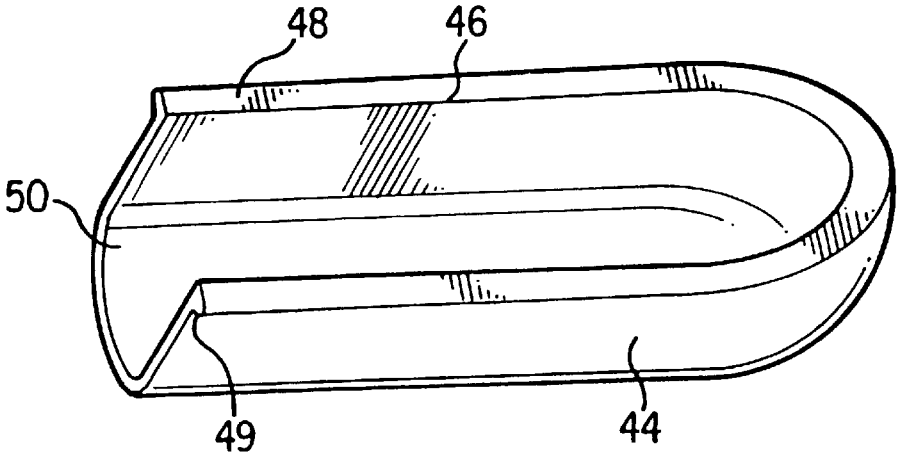
FIG. 4 is a perspective view of a molded heel cup.
Figure 5:
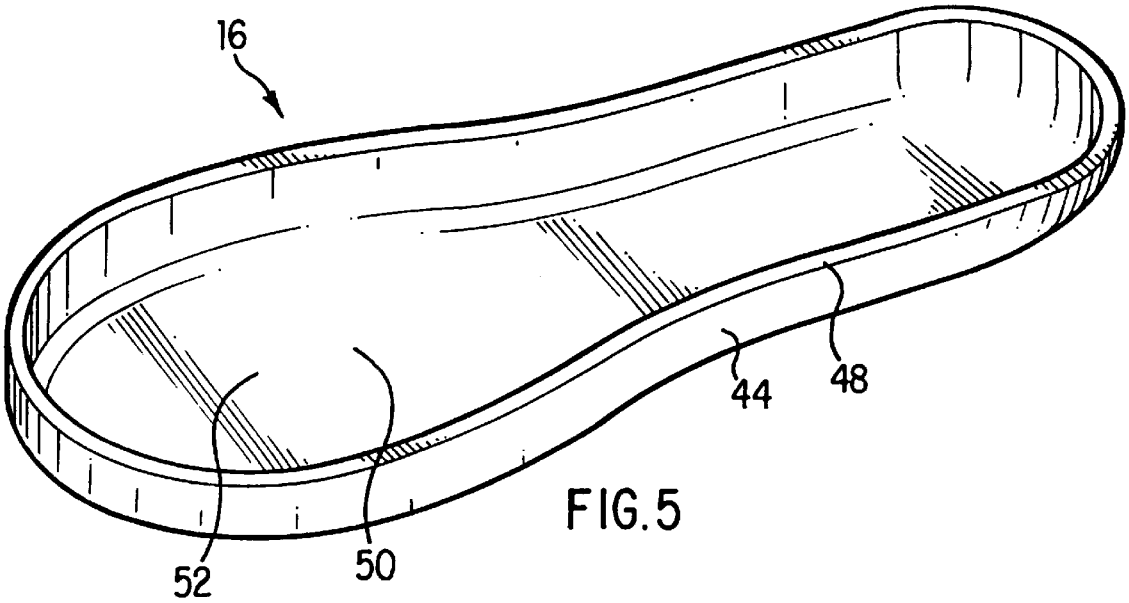
FIG. 5 is a perspective view an alternative embodiment of the molded heel cup.

A preferred embodiment of molded heel cup 15 is shown in FIG. 4. An exterior surface 44 of molded heel cup 15 includes a top edge 46 from which a flange 48 extends outwardly and is substantially perpendicular to exterior surface 44. Flange 48 extends around substantially the entire exterior surface 44 of molded heel cup 15. Molded heel cup 15 preferably includes a base plate 50 with a top surface 52 where the wearer's foot rests. Molded heel cup 15 extends around the heel area and stops approximately half way to threequarters of the way towards the front of shoe 10. Alternatively, the molded heel cup may extend around the entire shoe, as best seen in FIG. 5. In this embodiment, the molded cup 17 extends from the heel to the toe area of shoe 10. Molded heel cup 15 and molded cup 17 are preferably made of thermoplastic ruber, but may also be made of hytrel or any other suitable plastic, injection molded material.

Figure 6:
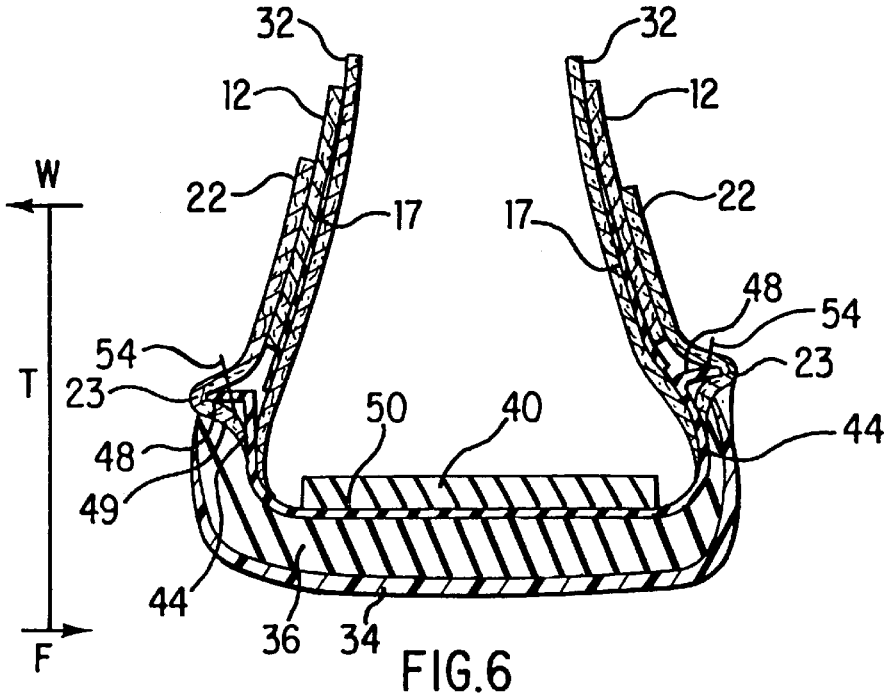
FIG. 6 is a fragmentary cross-sectional view of the back part of the shoe taken along section line 6—6 of FIG. 1.

In the manufacture of shoe 10, upper 12 consisting of vamp 20, quarter panels 21, foxing 22, eyestay 28, tongue 30, and lining 32 are assembled in the manner shown and described, and thereafter heel counter 17 is inserted into the back part of upper 12 between foxing 22 and lining 32. Molded heel cup 15 is located in the heel area of shoe 10. In a preferred construction, best seen in FIG. 6, a lasting margin 23 of foxing 22 extends around outwardly extending flange 48 of molded cup 15, covers a bottom surface 49 of outwardly extending flange 48, and is cemented to exterior surface 44 of molded heel cup 15. Foxing 22 is joined to outwardly extending flange 48 by joining means 54, which is stitching in the preferred embodiment, but may also be cement. Midsole 36 and outsole 34 are cemented to molded heel cup 15, and cap be wrapped up onto exterior surface 44 of molded heel cup 15 up to outwardly extending flange 48.

Figure 7:
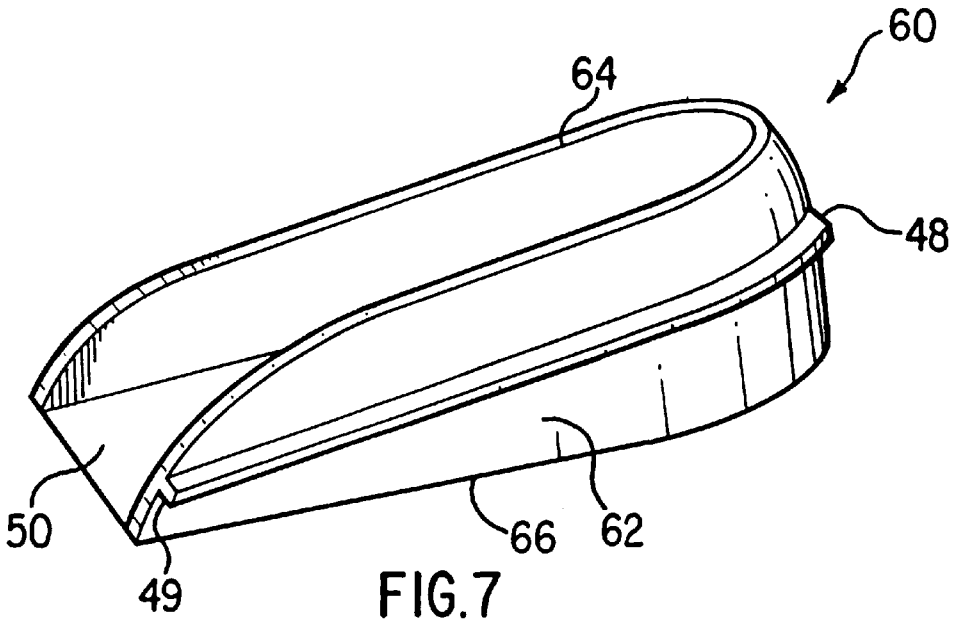
FIG. 7 is a perspective view of an alternative embodiment of a molded heel cup.
Figure 8:
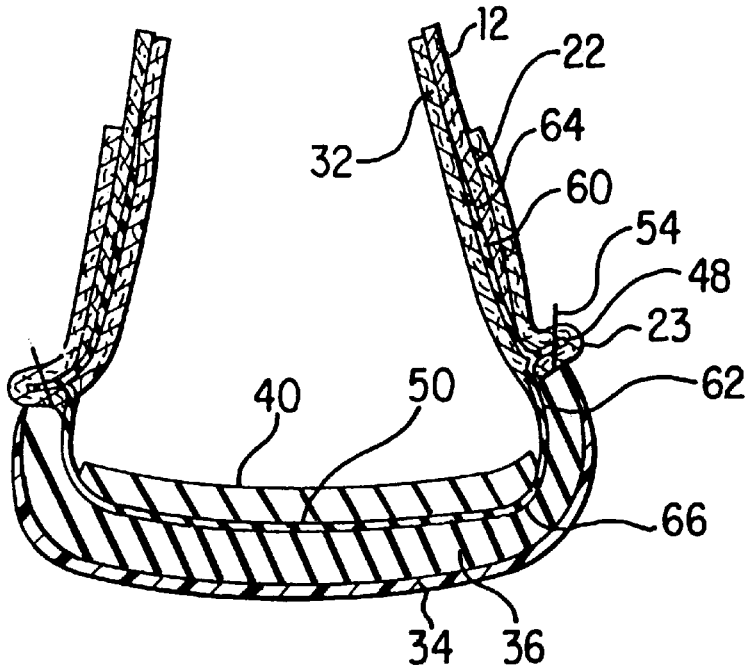
FIG. 8 is a fragmentary cross-sectional view of the back part of the shoe with the alternative embodiment of the molded heel cup.

In an alternative embodiment molded heel cup 15 and heel counter 17 may be combined to form a unified molded unit 60, as best seen in FIGS. 7 and 8. In this alternative embodiment, an exterior surface 62 of unified molded unit 60 extends between a top edge 64 and a bottom edge 66 of unified molded unit 60. Flange 48 extends outwardly from and is substantially perpendicular to exterior surface 62, between top edge 64 and bottom edge 66. Exterior surface 62 extends above and below flange 48 to top edge 64 and bottom edge 66, respectively. Flange 48 is preferably located at an approximate midpoint between top edge 64 and bottom edge 66. However, the location of flange 48 may be varied along exterior surface 62 to allow for a variety of aesthetic designs of shoe 10, as well as varying degrees of lateral stability. As seen in FIG. 8, lasting margin 23 of foxing 22 covers exterior surface 62 of unified molded unit 60 above flange 48, extends around flange 48, covers a bottom surface 49 of flange 48, and terminates on exterior surface 62 of unified molded unit 60 below flange 48. Joining means 54 joins lasting margin 23 of foxing 22 to flange 48 of unified molded unit 60.

The alternative embodiment described above with respect to FIG. 7 may comprise two pieces joined together at flange 48. In such an embodiment, heel counter 17 includes a flange extending outwardly from a bottom edge of heel counter 17 and molded heel cup 15 includes a flange extending outwardly from a top edge of molded heel cup 15. Heel counter 17 and molded heel cup 15 are placed such that their respective flanges are in a face to face relationship. The remaining structure is as described above and shown in FIGS. 7 and 8. The flanges of molded cup 15 and heel counter 17 may be joined prior to being inserted in shoe 10 or by joining means 54.

The above-described construction improves lateral stability of shoe 10 by locating outwardly extending flange 48 some vertical distance away from where the wearer's foot rests, The wearer's foot essentially rests at top surface 52 of base 50 of molded heel cup 15 or immediately above footbed 40. Rollover is caused by torque T, indicated by arrows in FIG. 6. Torque T is normally caused by a friction or other force F acting opposite the horizontal component of the force W created by the wearer's movement. Locating outwardly extending flange 48 above the bottom of the wearer's foot creates a resistance to torque T, thereby improving lateral stability in shoe 10.

Another important feature of this construction is that outwardly extending flange 42 does not need to be stitched to insole 38, as is described in the '275 and '808 patents. When utilizing the construction described in the '275 and '808 patents, the aesthetic design is limited by requiring outwardly extending flange 42 to be located immediately above insole 38. By varying the location of flange 42, a variety of designs can be employed. For example, midsole 36 and outsole 34 can wrap up onto the sides of shoe 10 to meet outwardly extending flange 52. This provides the additional benefit of improving lateral stability through use of the generally harder outsole 34 in the vertical plane, as well as allowing variability in design.

The preferred embodiments were chosen and described in order to best explain the principles of the present invention and its practical application to thereby enable others skilled in the art to best utilize the invention in various embodiments and with various modifications as are suited for the particular use intended. It is intended that the scope of the invention be defined by the claims appended hereto.

What is claimed is:

1. A shoe comprising:

a molded cup having a flange extending outwardly from a top edge of said molded cup;

an upper having a forepart and a rearpart, wherein said rearpart of said upper has a lasting margin which covers a top surface of said outwardly extending flange of said molded cup, a bottom surface of said outwardly extending flange of said molded heel cup, and terminates on an exterior surface of said molded cup;

means for joining said rearpart of said upper to said outwardly extending flange;

an insole coupled to said molded cup and coupled to a lasting margin of said forepart of said upper; and a sole component coupled to said molded cup and said insole.

2. A shoe as in claim 1, wherein said lasting margin of said rearpart of said upper is cemented to said exterior surface of said molded cup.

3. A shoe as in claim 1, wherein said lasting margin of said forepart of said upper is cemented to said insole.

4. A shoe as in claim 1, wherein said sole component is cemented to said insole and to said molded cup.

5. A shoe as in claim 1, wherein said sole component comprises a midsole and an outsole.

6. A shoe as in claim 1, wherein said rearpart of said upper which covers said molded cup is foxing.

7. A shoe as in claim 1, wherein said means for joining comprises stitching.

8. A shoe as in claim 1, wherein said lasting margin of said rearpart of said upper covers only a top surface of said outwardly extending flange of said molded cup.

9. A shoe as in claim 1, wherein said molded cup is selected from the group of materials consisting of thermoplastic rubber or a plastic, injection molded material.

10. A shoe, comprising:

a molded cup having a flange extending outwardly from an exterior surface of said molded cup between a top edge and a bottom edge of said molded cup;

an upper having a forepart and a rearpart, wherein said rearpart of said upper has a lasting margin which covers said exterior surface of said molded cup above said outwardly extending flange, a top surface of said outwardly extending flange of said molded cup, a bottom surface of said outwardly extending flange of said molded heel cup, and terminates on an exterior surface of said molded cup below said outwardly extending falnge;

means for joining said rearpart of said upper to said outwardly extending flange;

an insole coupled to said molded cup and coupled to a lasting margin of said forepart of said upper; and a sole component coupled to said molded cup and said insole.

11. A shoe according to claim 10, wherein said joining means comprises stitching.

12. A shoe according to claim 10, wherein in said sole component comprises a midsole and an outsole.

13. A shoe according to claim 10, wherein said outwardly extending flange is located at the approximate midpoint between said top edge and said bottom edge of said molded cup.

14. A shoe according to claim 10, wherein said molded cup is selected from the group of materials consisting of thermoplastic rubber or plastic, injection molded material.

15. A shoe, comprising:

a molded cup having a flange extending outwardly from a top edge of said molded cup;

an upper having a lasting margin which covers a top surface of said outwardly extending flange of said molded cup, a bottom surface of said outwardly extending flange of said molded cup, and terminates on said exterior surface of said molded cup between said outwardly extending flange and a bottom edge of said molded cup;

means for joining said lasting margin of said upper to said outwardly extending flange; and a sole component coupled to said molded cup.

16. A shoe according to claim 15, wherein said molded cup includes of a heel counter with an flange extending outwardly from a bottom edge of said heel counter joined to a molded heel cup with a flange extending outwardly from a top edge of said molded heel cup.

* * * * *

UNITED STATES PATENT AND TRADEMARK OFFICE

CERTIFICATE OF CORRECTION

PATENT NO. : 6,018,891
DATED : February 1, 2000
INVENTOR(S) : Gary P. Duclos

It is certified that error appears in the above-identified patent and that said Letters Patent is hereby corrected as shown below:

Column 5,
Line 6, delete "falnge" and insert -- flange --

Column 6,
Delete lines 18-22 and insert:
-- 16. A shoe according to claim 15, further comprising a heel counter with a flange extending outwardly from a bottom edge of said heel counter joined to said flange of said molded cup. --

Signed and Sealed this

Twenty-first Day of August, 2001

*Attest:*

Nicholas P. Godici

*Attesting Officer*

NICHOLAS P. GODICI
*Acting Director of the United States Patent and Trademark Office*